United States Patent [19]

Kawano

[11] Patent Number: 4,666,289

[45] Date of Patent: May 19, 1987

[54] ELECTROPHOTOGRAPHIC COPYING MACHINE FOR DISPLAYING THE SIZE OF COPY AND COPY PAPER

[75] Inventor: Tadaaki Kawano, Nara, Japan

[73] Assignee: Sharp Kabushiki Kaisha, Osaka, Japan

[21] Appl. No.: 721,700

[22] Filed: Apr. 10, 1985

[30] Foreign Application Priority Data

Apr. 10, 1984 [JP] Japan ..... 59-73690

[51] Int. Cl.[4] ..... G03G 15/00

[52] U.S. Cl. ..... 355/14 R; 355/14 SH; 355/3 SH; 355/55

[58] Field of Search ..... 355/14 R, 14 C, 14 SH, 355/3 SH, 3 R, 55, 56, 61, 7; 340/700, 713, 718, 752, 753

[56] References Cited

U.S. PATENT DOCUMENTS

| | | | |
|---|---|---|---|
| 4,244,649 | 1/1981 | Rees et al. | 355/61 |
| 4,260,248 | 4/1981 | Murata et al. | 355/14 C X |
| 4,334,220 | 6/1982 | Suzuki et al. | 340/718 X |
| 4,338,020 | 7/1982 | Yakawa et al. | 355/61 X |
| 4,393,375 | 7/1983 | Sugiura | 355/14 R X |

FOREIGN PATENT DOCUMENTS

| | | | |
|---|---|---|---|
| 0172644 | 10/1983 | Japan | 355/14 C |

*Primary Examiner*—A. C. Prescott

*Attorney, Agent, or Firm*—Birch, Stewart, Kolasch and Birch

[57] ABSTRACT

An electrophotographic copying machine of a magnification/reduction-controllable type having a copy paper size display, a original copy picture size display, and a control circuit for controlling the operation of the two displays. Preferably, the copy picture size display is an analog display.

5 Claims, 8 Drawing Figures

ELECTROPHOTOGRAPHIC COPYING MACHINE FOR DISPLAYING THE SIZE OF COPY AND COPY PAPER

BACKGROUND OF THE INVENTION

The present invention relates to an electrophotographic copying machine and, more particularly, to an electrophotographic copying machine of a magnification/reduction-controllable type for displaying the size of a copy and a sheet of copy paper.

Conventionally, some types of electrophotographic copying machines are of a magnification/reduction-controllable type in which the times of magnifying or reducing a copy document can be selected. To operate such a type of copying machine, the operator must know the size of a copy. For those not familiar with this type of copying machine, therefore, it is desired to provide an improved copying machine of a magnification/reduction-controllable type for showing the size of the copy.

SUMMARY OF THE INVENTION

Accordingly, it is an object of the present invention to provide an improved electrophotographic copying machine with a magnification/reduction-controllable function for displaying the size of a copy and a sheet of copy paper.

It is another object of the present invention to provide an improved electrophotographic copying machine of a magnification/reduction-controllable type for displaying the size of a sheet of copy paper and the size of a copied image.

It is a further object of the present invention to provide an improved electrophotographic copying machine with a magnification/reduction-controllable type for displaying the size of a sheet of copy paper to be used and the size of a copied image in an analog display.

Briefly described, in accordance with the present invention, an electrophotographic copying machine with a magnification/reduction-controllable function comprises copy paper size display means for displaying the size of a sheet of copy paper on which a copy of a copy document is to be made, copy picture size display means for displaying the size of a copy picture in which a copy of the copy document is to be made, and control means for controlling to operate said copy paper size display means and said copy picture size display means.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE PREFERRED EMBODIMENTS

Figure 1:
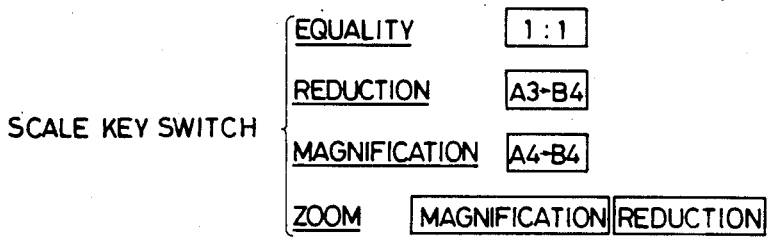
FIG. 1 is a plan view of a scale switch keyboard used for the present invention.

FIG. 1 is a plan view of a scale switch keyboard used in an electrophotographic copying machine with a magnification-controllable function according to the present invention.

Throughout the description in the present specification, the size of a sheet of copy paper to be used for the copying machine is assumed to be B4 while the size of a copy document to be copied is assumed to be A3 or B4, so that the display of an analog display should be displayed as being limited to them with omitting other examples. It may be evident that any other size and display formats are possible. With reference to FIG. 1, the scale switch keyboard includes some key switches each actuated to select each of modes for "EQUALITY, 1:1", "REDUCTION, A3-B4", "MAGNIFICATION, A4-B4", "ZOOM, REDUCTION or MAGNIFICATION".

Figure 2:
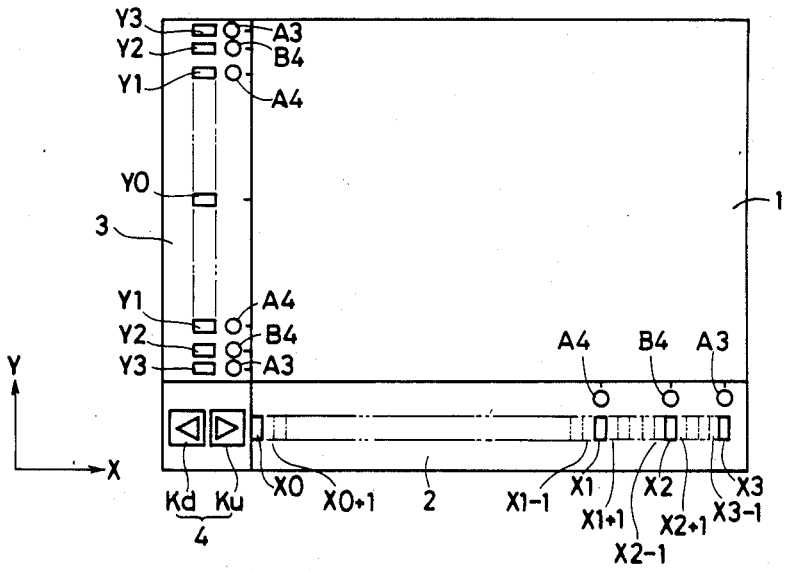
FIG. 2 is a plan view of a document table including an analog display provided in an electrophotographic copying machine of a magnification/reduction-controllable type according to a first preferred embodiment of the present invention.

FIG. 2 is a plan view of an electrophotographic copying machine with a magnification/reduction-controllable type according to a first preferred embodiment of the present invention. The copying machine of FIG. 2 is provided with a document table 1 with two analog displays of an X-side display 2, a Y-side display 3, and a copy picture size key 4. The table 1 is composed of a glass plate on which a copy document to be copied is mounted. The X-side display 2 and the Y-side display 3 are provided for displaying the lengths of the copy document along the horizontal side (X side) and the vertical side (Y side) of the copy document, respectively. Each of the X-side display 2 and the Y-side display 3 comprises some lamps related to "A4", "B4" and "A3". The copy picture size key 4 is provided for modifying the selection of the size of the copy document.

According to the present invention, each of the lamps "A4", "B4", and "A3" is switched ON to indicate the size of a sheet of copy paper by a copy paper size measurement means in the copying machine when a paper cassette storing a plurality of sheets of copy paper is mechanically coupled to the copying machine. If the cassette is not coupled to the copying machine, none of the lamps are switched ON. When a specific type of cassette is coupled to the copying machine, one of the lamps equivalent to the size of the copy paper is switched ON to designate the size of the presently coupled copy paper. When the magnification or the reduction mode is selected by the scale switch keyboard of FIG. 1 in which the copy area able to copy is not equivalent to the size of the copy paper, the lamp showing the size of the copy paper is continually illuminated. In addition, to show the area of the copy picture or image actually copied on the copy paper, the X-side display 2 and the Y-side display 3 include a plurality of copy size lamps X0, X0+1, . . . , X1, X1+1, . . . , X2, X2+1, . . . , X3−1, and X3, and Y0, Y0+1, . . . , Y1, Y1+1, . . .

, Y2, Y2+1 . . . , Y3−1, and Y3, respectively, although the small-distance size lamps along the Y side such as Y0+1, Y0+2, and the like other than Y0, Y1, Y2, and Y3 are omitted from drawing. As FIG. 2 shows, X1 and Y1 relate to the A4 size lamp. X2 and Y2 relate to the B4 size lamp. X3 and Y3 relate to the A3 size lamp. Preferably, each of the copy size lamps comprises a light emitting diode (LED) of about 3 mm×5 mm.

The copying machine is operated as follows:

I. EQUALITY MODE

When the copy paper cassette is mechanically coupled to the copying machine, one of the copy paper size lamps "A4", "B4", and "A3" is illuminated. For convenience of description only, the size of the copy paper is limited to "B4", so that the lamp of "B4" is illuminated. When the equality mode is selected by the "EQUALITY" key switch in FIG. 1, a copy document to be copied is mounted on the table 1, whereby a copy start switch is actuated to copy the copy document.

II. REDUCTION/MAGNIFICATION MODE

To copy an A3 size copy document on a B4 size sheet of copy paper, such a copy document is mounted on the table 1. A "Ku" button in the copy picture size key 4 is operated to subsequently illuminate the plurality of copy size lamps X0, . . . , X3 from X0 along the X-direction. In this case, the size of the copy document is A3, so that all the lamps X0 to X3 are illuminated to show this size. When the B4 size copy document is mounted, the "Ku" button should be operated to illuminate the copy size lamps up to the X2 lamp to indicate that size.

In the description of the present specification, the size of the copy document is assumed to be formatted, so that a ratio of an X side length to a Y side length is constant. The selection of the X-side copy size lamps automatically enables the selecting of the Y-side copy size lamps to thereby illuminate all the lamps from Y0 to Y3, both inclusive, for the A3 size copy document. For non-formatted copy paper, an additional copy size key switch should be provided for selecting the copy size along the Y side.

Thus, the copy paper size lamp for "B4" is illuminated and the copy picture size lamps of X0 to X3 and Y0 to Y3 are all illuminated. It may be evident that the size of the copy picture is larger than that of the copy paper and that the size of the copied picture should be reduced to the B4 size of the copy paper. The reduction mode is therefore selected by operating the key of "REDUCTION, A3-B4" as shown in FIG. 1. Now, the copy size lamps from "X0" to "X2" and from Y0 to Y2 remain illustrated with switching OFF the remaining lamps, indicating that the size of the copied picture is reduced from A3 to B4. A copy can be made in response to the actuation of the copy start switch.

Simalarily, a copy can be made in the magnification mode, being magnified from A4 to B4 using the key of "MAGNIFICATION, A4-B4".

Another button "Kd" within the copy picture size key 4 is provided for switching OFF some illuminated copy picture size lamps. For example, to modify the selection from A3 size copy picture to B4 size copy picture, the "Kd" button is continually actuated for switching OFF copy picture size lamps X3, X3−1, . . . , X2+1. They are all illuminated. Similarily, the copy picture size lamp Y3 is switched OFF and Y2 is switched ON to designate B4 size. The "Kd" button is continually operated to erase all the lamps so as to cancel the selection of any copy picture size.

Another type of copying machine is provided with a zoom function for freely magnifying or reducing the size of a copy document. Such a copying machine can freely magnify and reduce any non-formatted copy document into a formatted size copy. For example, a non-formatted copy document has a width of X3−1. The length of the copy document is now neglected for description. The "Ku" button in the copy picture size key 4 is operated for selecting the copy document size to be X3−1, so that all the lamps from X0 to X3−1 are switched ON. The size of a sheet of copy paper is B4. Because the size of the copy document is larger than that of the copy paper, the "ZOOM, REDUCTION" button in FIG. 1 is operated. The "kd" button in the copy picture size key 4 is actuated for erasing the lamps from X3−1 to X2+1, both inclusive. At the time when the X2+1 lamp is switched OFF, the actuation of the "ZOOM, REDUCTION" button is stopped. In response to the actuation of the copy start switch, then, a copy of the X3−1 size copy document is made with reduction in the form of B4 size related to X2.

The control panel of the copy machine as shown in FIG. 2 can be operated to freely magnify or reduce the size of a copy document in the same manner as stated above. In the above description, it is described that the actuation of the "ZOOM, REDUCTION" button is stopped at the time when the X2+1 size lamp is switched OFF. Otherwise, if the actuation of the "ZOOM, REDUCTION" button is stopped in other portions, a desirable size copy of the B4 size copy document can be made. The "ZOOM, MAGNIFICATION" button can be similarly operated to freely magnify the size of the copy document. The copy picture size lamps as illustrated may be replaced by any other marks such as slide lever means.

Figure 3:
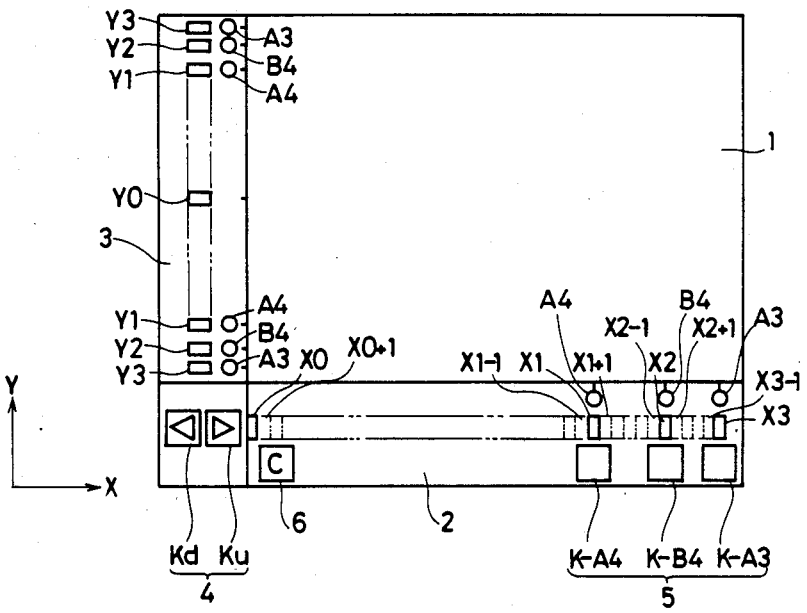
FIG. 3 is a plan view of a document table including an analog display in a copying machine of a magnification-controllable type according to a second preferred embodiment of the present invention.

FIG. 3 is a plan view of a document table used in the copying machine according to a second preferred embodiment of the present invention.

A formatted copy document size key 5 is provided which is operated as related to the illuminations of the copy picture size lamps. A cancel key 6 is provided for canceling a specific copy picture size mode or a magnification/reduction mode, and returning to the equal-copy mode as the normal mode in which a copy of the copy document can be made in the same dimension.

The size of the copy document is normally formatted. In the case of A4 size copy document, a "K-A4" button within the formatted copy document size key 5 is operated once, so that the copy size lamps from X0 to X1, both inclusive, and from Y0 to Y1, both inclusive, are all switched ON. In the case of non-formatted copy document size which is relatively similar to the size of a formatted A4 size, the "K-A4" button is first operated and either "Ku" or "Kd" button is operated to modify the display portion, whereby an exact size of the copy document can be selected. The cancel key 6 is operated to erase all the copy picture size lamps and change any magnification/reduction mode into the equal-copy mode. Alternatively, the copy paper size lamps remain illuminated to designate A4, B4, or A3 depending on the present copy paper size. Thus, the copy picture size gets back into a normal mode. Otherwise, of course, it may be possible that all of the copy picture size lamps are illuminated in the normal mode, or some of them are illuminated corresponding to the size of the copy paper.

Figure 4:
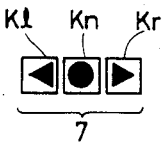
FIG. 4 is a plan view of a copy picture shift key according to a third preferred embidiment of the present invention.
Figure 5:
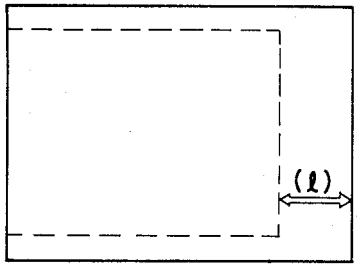
FIGS. 5(A) and 5(B) are an illustration showing conditions of shifting a copy picture by the copy picture shift key of FIG. 4.
Figure 5:
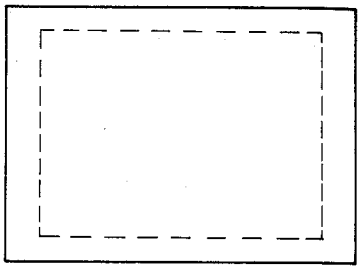

FIG. 4 shows a copy picture key 7 provided on the document table of the copying machine according to a third preferred embodiment of the present invention. FIGS. 5(A) and 5(B) show a pre-condition and a post-condition, respectively, of shifting a copy picture position with operating the copy picture shift key 7.

The copy picture shifting function is used in case where the size of the copy document is too small for the size of the copy paper, or it is necessary to provide a blank portion around the copied image or adjacent to the copied image for punching and filing. The copy picture shift key 7 contains a "K1" button actuated to shift the display of the size lamps to the left portions, a "Kr" button actuated to shift the display of them to the right portions, and a "kn" button actuated to return the display of them to the normal positions without any shift.

In the case of FIG. 5(A), it is assumed that the size of the copy paper is B4 and the copy picture size is A4 regardless of the selection of either the equal-copy mode or the magnification/reduction mode. On the document table of FIG. 2, the copy paper size lamps are illuminated to designate B4 and the copy paper size lamps from X0 to X1 and from Y0 to Y1 are illuminated. The difference between X1 and X2 caused by the difference between the copy paper size and the copy picture size corresponds to the length of (l) in FIG. 5(A). In the magnification/reduction mode, the times of magnification or reduction are taken consideration. The copy picture shift key 7 of FIG. 4 is operated to shift the position of a copied picture by a desired amount. To shift the copied picture to the center of the copy as shown in FIG. 5(B), the "Kr" button within the copy picture shift key 7 is operated so that new copy picture size lamps are started to be illuminated up to the center between X1 and X2, so that the copy picture is shifted to the center between X1 and X2. The position of the illuminated copy picture size lamps is shifted in the right direction and some lamps from X0, X0+1, . . . , are erased.

Figure 6:
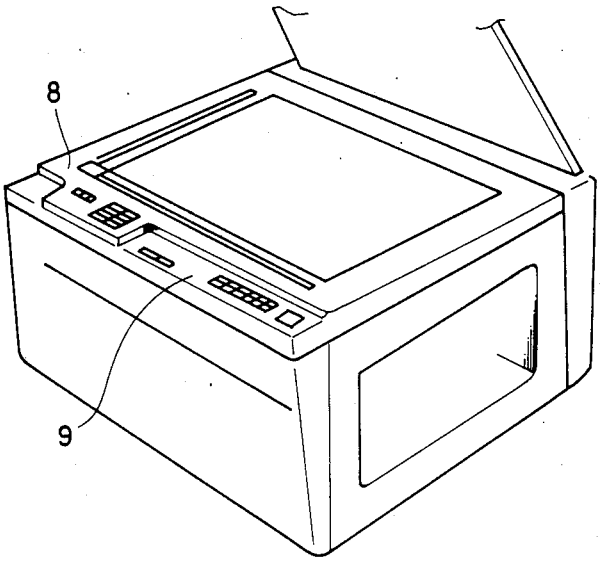
FIG. 6 is a perspective view of an electrophotographic copying machine according to a fourth preferred embodiment of the present invention.

FIG. 6 shows a further copying machine according to a fourth preferred embodiment of the present invention.

The copying machine of FIG. 6 is of the type in which the copy picture arrangement function key for controlling the illumination of the copy paper size lamps and the copy picture size lamps as mentioned above is positioned on an upper table and separated from the general keyboard, positioned at a lower table, for operating the copying machine. An upper document table 8 carries the afore-mentioned copy paper size lamps, the copy picture size lamps, and the scale key switch, and the copy picture shift key. A general and lower keyboard 9 is provided, containing a copy start switch and the conventional keyboard for operating the copying machine, including the setting of the number of copies, the exposure amount control key, copy paper size selection key.

Because of appearance and function capability, the copy picture arrangement keyboard is concentrated on the upper table while the general keyboard is positioned on the lower table.

Figure 7:
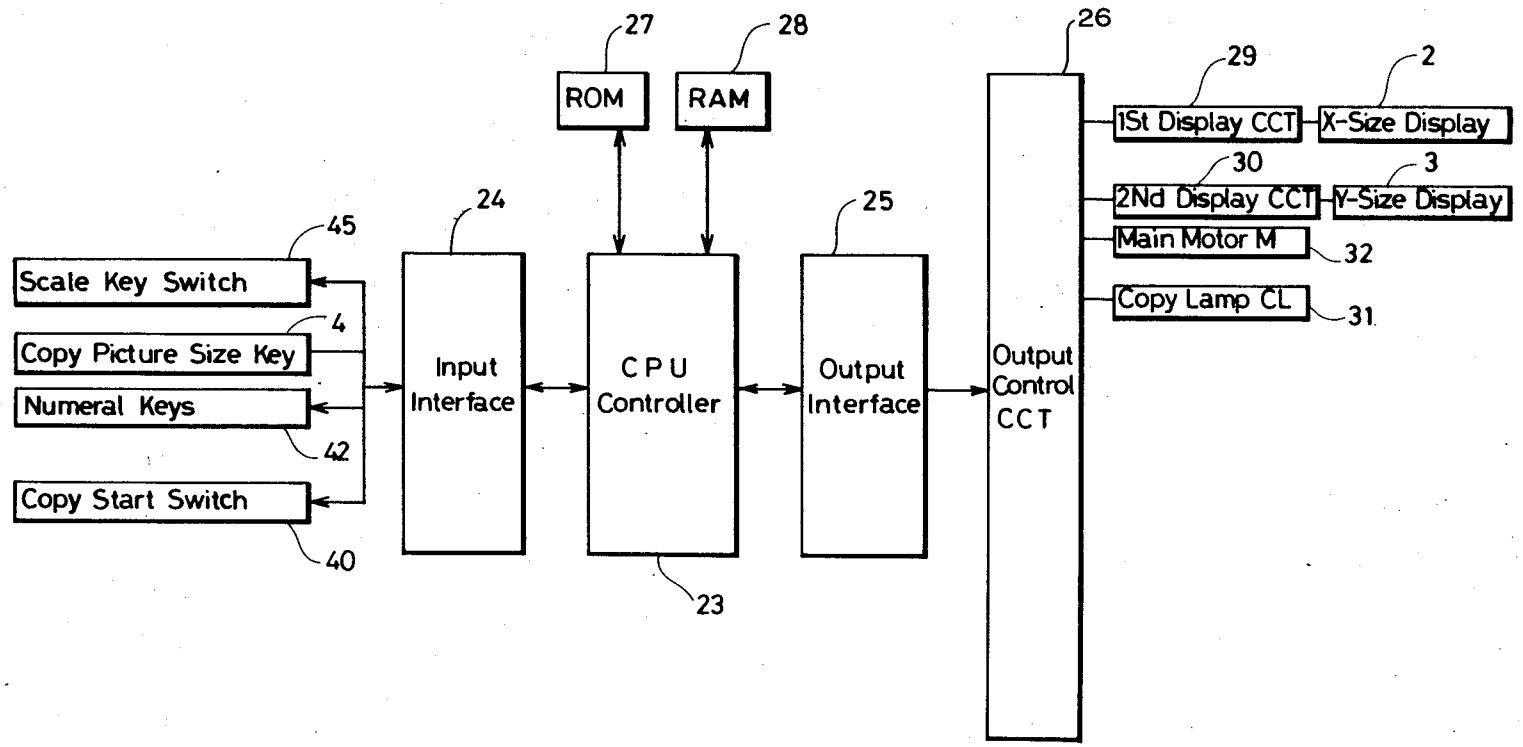
FIG. 7 is a block diagram of the copying machine according to the present invention.

FIG. 7 is a block diagram of all types of copying machines according to the present invention.

The circuit of the copying machine comprises an input interface 24, a central processing unit (CPU) controller 23, an output interface 25, an output control circuit 26, a read only memory (ROM) 27, a random access memory (RAM) 28, a first display circuit 29, a second display circuit 30, the X-side display 2, the Y-side display 3, a main motor (M) 32, a copy lamp (CL) 31, a copy start switch 40, numeral keys 42, a scale key switch 45, and the copy picture size key 4.

The CPU controller 23 is operated to dominate the operation of the copying machine. The input interface 24 is operated to communicate the CPU controller 23 with the copy start switch 40, the numeral keys 42, the mode select switch 45, and the copy picture size key 4. The ROM 27 stores the control program executing the copy equal mode and the magnification/reduction mode. The RAM is provided for storing the necessary information to execute the program. The scale key switch 45 corresponds to that of FIG. 1. The numeral keys 42 are operated to select the suitable type of copy paper by the operator and to input the number of copies to be made. The copy start switch 40 is operated to start the copy operation. As stated above, the X-side display 2 and the Y-side display 3 enable the displays of size lamps of any possible type according to the present invention. The first and the second display circuit 29 and 30 are provided for enabling the displays in the X and Y-side display and 3, respectively. The copy lamp (CL) 31 is operated to show that a set of copy operation is now possible. The output control circut 26 is responsive to the CPU controller 23 through the output interface 25 for controlling the first and the second display circuits 29 and 30, the main motor (M) 32, and the copy ready lamp 31. The main motor (M) 32 is provided for rotating a photoreceptor and other elements.

While only certain embodiments of the present invention have been described, it will be apparent to those skilled in the art that various changes and modifications may be made therein without departing from the spirit and scope of the present invention as claimed.

What is claimed is:

1. An electrophotographic copying machine of a magnification/reduction-controllable type for copying an original document onto a paper, comprising:

copy paper size display means for displaying the size of a sheet of copy paper onto which a copy of an original document is to be made;

original document size display means of analog form for displaying the size of an original document of which a copy of the original document is to be made and for enabling an operator to visually compare the size of the copy paper and the original juxtapositioned with respect to said copy paper size display means; and control means for operating the copy paper size display means and original (picture) document size display means.

2. The machine of claim 1, further comprising control switch means which when actuated modifies the display portions of said original document size display means thereby copying the original document in a modified dimension.

3. The machine of claim 1, wherein said copy paper size display means is a lamp means for indicating a specific size of a sheet of copy paper.

4. The machine of claim 1, further comprising shift means for shifting the position of an original document on said copy paper.

5. The machine of claim 4, further comprising control switch means which when actuated modifies the display portions of said original document size display means thereby copying the original document in a modified dimension.

* * * * *